US007066279B2

(12) United States Patent
Randa

(10) Patent No.: US 7,066,279 B2
(45) Date of Patent: Jun. 27, 2006

(54) PNEUMATIC GROUND PIERCING TOOL

(75) Inventor: Mark D. Randa, Summit, WI (US)

(73) Assignee: Earth Tool Company, L.L.C., Oconowoc, WI (US)

( * ) Notice: Subject to any disclaimer, the term of this patent is extended or adjusted under 35 U.S.C. 154(b) by 0 days.

(21) Appl. No.: 10/984,579

(22) Filed: Nov. 8, 2004

(65) Prior Publication Data

US 2006/0096769 A1 May 11, 2006

(51) Int. Cl.

| | |
|---|---|
| ***B25D 11/00*** | (2006.01) |
| ***B25D 13/00*** | (2006.01) |
| ***E21B 11/02*** | (2006.01) |
| ***E21B 10/38*** | (2006.01) |

(52) U.S. Cl. ..... 173/91; 173/212; 175/19; 175/296

(58) Field of Classification Search ..... 173/13, 173/14, 91, 128, 132, 133, 212; 175/19, 175/22, 296

See application file for complete search history.

(56) References Cited

U.S. PATENT DOCUMENTS

| | | | | |
|---|---|---|---|---|
| 3,708,023 A | | 1/1973 | Nazarov et al. | 175/19 |
| 3,826,316 A | * | 7/1974 | Bassinger | 173/73 |
| 4,290,489 A | * | 9/1981 | Leavell | 173/17 |
| 5,031,706 A | | 7/1991 | Spektor | 175/19 |
| 5,095,998 A | | 3/1992 | Hesse et al. | 173/133 |
| 5,226,487 A | * | 7/1993 | Spektor | 175/19 |
| 5,311,950 A | * | 5/1994 | Spektor | 175/19 |
| 5,465,797 A | * | 11/1995 | Wentworth et al. | 173/91 |
| 5,467,831 A | * | 11/1995 | Spektor | 175/19 |
| 5,505,270 A | * | 4/1996 | Wentworth | 173/1 |
| 5,603,383 A | | 2/1997 | Wentworth et al. | 173/91 |
| 6,269,889 B1 | | 8/2001 | Wentworth | 173/91 |
| 6,273,201 B1 | | 8/2001 | Randa et al. | 175/19 |
| 6,923,270 B1 | * | 8/2005 | Randa | 173/91 |
| 6,953,095 B1 | * | 10/2005 | Randa | 173/1 |

* cited by examiner

*Primary Examiner*—Scott A. Smith
*Assistant Examiner*—Brian Nash
(74) *Attorney, Agent, or Firm*—Philip G. Meyers

(57) ABSTRACT

A ground piecing tool includes a housing and an air distributing mechanism that reciprocates a striker to impact a chisel shaft in response to a supply of compressed fluid including a fluid inlet tube mounted in the bore of the striker having a radial port, a rear end of the inlet tube being in communication with the distributing mechanism, wherein the housing and chisel shaft cooperate to define a front chamber that decreases in volume as the chisel moves forward relative to the housing, and wherein the chisel shaft has a radial passage therein that conducts compressed fluid from the radial port of the inlet tube to the front chamber, which is configured to form an air spring.

18 Claims, 5 Drawing Sheets

PNEUMATIC GROUND PIERCING TOOL

TECHNICAL FIELD

The invention relates to pneumatic ground piercing tools, and in particular, to a moveable chisel head assembly for pneumatic impact tool.

BACKGROUND OF THE INVENTION

Pneumatic impact ground piercing tools have been commercially useful products for decades. Self-propelled pneumatic ground piercing tools are used to install pipelines, power lines and information transmission cables such as fiber optics installed beneath the ground with a minimal amount of surface disruption. These tools include, as general components, a torpedo-shaped body having a tapered nose and an open rear end, an air supply hose that enters the rear of the tool and connects it to an air compressor, a piston or striker disposed for reciprocal movement within the tool, and an air distributing mechanism for causing the striker to move rapidly back and forth.

In the case of hard or rocky ground, it is often desirable to utilize pneumatic ground tools that incorporate movable bits or chisels at the tapered nose section of the tool to concentrate the striking force. For example, U.S. Pat. No. 6,273,201 to Randa et al., issued Aug. 14, 2001, the contents of which are incorporated herein for all purposes, discloses a reciprocating (front) head mole with a moveable chisel head that is axially independent of the remainder of the mole. Randa et al. facilitates transfer of striker energy directly to the leading end of the mole thereby improving productivity in hard ground.

In many cases, impact moles are started from pits dug in the earth. The mole is launched when the air valve supplying the mole with compressed air is opened, actuating the striker to begin impacting. The front end of the mole is forced against the sidewall of the launch pit until the mole penetrates the earth far enough so that sufficient friction force is produced between the mole body and the soil to hold the mole in position against the pneumatic reaction forces generated as the striker reciprocates.

Launching larger diameter pneumatic impact tools, for example in the range of 4" diameter, tend to be considerably more difficult to start than smaller tools with diameters in the range of 2". As the striker impacts the chisel and then the anvil, it generates a reaction force that first tends to move the movable head or chisel of the tool forward, then pull the tool body along behind. The striker then moves rearwardly in preparation for the next stroke. The difficulty arises as the striker reverses its direction and move forward for the next impact under the action of compressed air in the rear pressure chamber. The reaction force from this operation tends to move the tool body rearwardly. During normal operation when the mole is fully engaged in a borehole, friction between the surface of the tool body and the surrounding soil absorbs this reaction force, allowing the tool to make net forward progress through the ground. However, when the mole is first launched and only the head is engaged by the soil, the reaction forces generated by reciprocation of the striker can cause the movable head to lose engagement with the soil and requires the operator to manually apply an opposing force until the mole has penetrated the earth far enough so that friction between the mole and the soil holds the mole body in place. In soft soil, the friction between the mole body and the soil may not be sufficient to hold the mole in place, making start-up unusually difficult.

Most prior movable chisel-type ground piercing tools have used a metal spring or springs to bias the chisel in a rearward direction to return the chisel to its starting position after being impacted by the striker and partially absorb reaction forces during the forward stroke of the striker that would otherwise tend to make the tool body to move backward, especially during startup. For example, U.S. Pat. No. 5,095,998 to Hesse et al., issued Mar. 17, 1992, the entire contents of which are incorporated by reference herein for all purposes, discloses such an arrangement. However, the use of springs in this application raises issues of durability and design. Pneumatic impact moles normally operate at a relatively high impact frequency, typically in the range of 250 to 600 impacts per minute. Assuming an average travel rate of 1 foot/minute and 300 foot of boring per day, an impact mole may be subjected to 50 million impacts per year. Under these conditions, a spring is subject to fatigue fractures.

SUMMARY OF THE INVENTION

A ground piercing tool according to the invention includes an elongated tubular tool housing with a front anvil having a lengthwise bore through the anvil. A striker reciprocates within an internal chamber of the housing to impart impacts to a front impact surface of the anvil for driving the tool forwardly through the ground. A chisel including a front head and a rearwardly extending chisel shaft slides within the bore of the anvil, the chisel being movable between a rearward most position at which a rear end portion of the chisel shaft protrudes from the bore of the anvil to receive an initial impact from the striker and a forward most position at which the striker impacts on a rear impact surface of the anvil. A distributing mechanism reciprocates the striker in response to a supply of compressed fluid. A front chamber defined by the housing and chisel shaft decreases in volume as the chisel moves forward relative to the housing, and the distributing mechanism includes passages that conduct compressed fluid to the front chamber, which front chamber is configured to form a gas (air) spring using such compressed fluid.

In one aspect, the distributing mechanism includes a fluid inlet tube mounted in the bores of the anvil and striker includes a radial port and the chisel shaft has a radial passage therein that conducts compressed fluid from the radial port of the inlet tube to the front chamber which is configured to form an air spring using the compressed fluid. The invention further provides an improved mechanism for removably securing a movable chisel to the tool body, which mechanism uses a jamb nut mounted between the chisel head and the anvil. These and other features of the invention are described further in the detailed description that follows.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts, and in which.

DETAILED DESCRIPTION OF THE INVENTION

Figure 1:
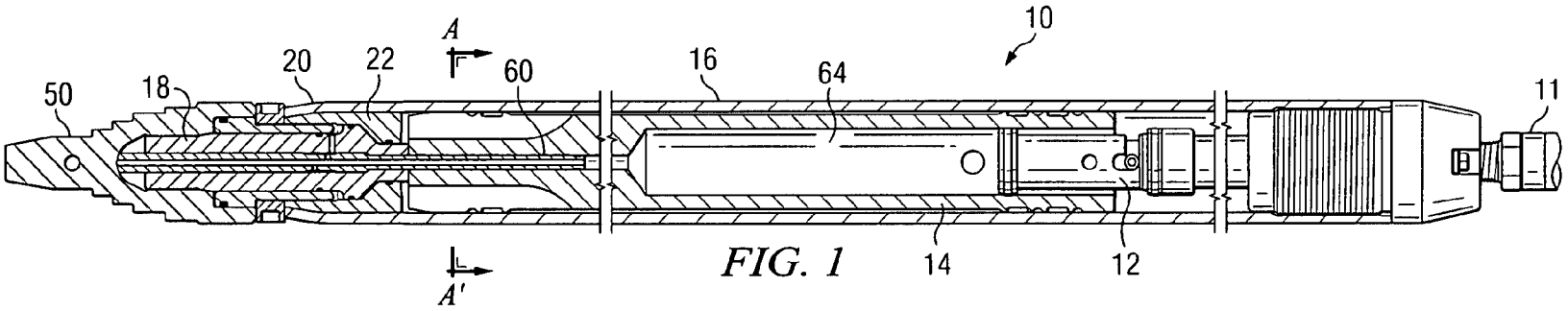
FIG. 1 is a longitudinal sectional view of a pneumatic ground piercing tool according to the invention showing the position of the striker at the moment it contacts the chisel shaft.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

According to the invention, a moveable bit pneumatic ground tool is provided with a variable volume forward chamber that is pressurized with a fluid such as compressed air to form an air spring. The air spring offsets a substantial fraction of the reaction force generated when the striker of the tool is accelerated during the forward stroke of the striker. Reducing the reaction force in this manner substantially reduces the amount of force that must be applied by the operator as the tool is launched and reduces the tendency of the bit to break lose from the surrounding soil and/or to move backwards in the borehole.

Referring now to FIGS. 1–4, a pneumatic ground piercing tool 10 having a movable chisel assembly according to the invention includes an air distributing mechanism 12 for reciprocating a striker 14 disposed within elongated tubular tool housing 16. Air distributing mechanism 12 includes a reversing mechanism actuated by rotating the air supply hose in a manner known in the art. A preferred air distributing mechanism for use in the present invention are exemplified in U.S. Pat. No. 5,603,383, Feb. 18, 1997, the entire contents of which are hereby incorporated by reference herein. Compressed air is supplied through a hose 11 to air distributing mechanism 12, which causes striker 14 to reciprocate within housing 16.

Housing 16 is cylindrical and is swaged or machined to a reduced diameter nose 20 at its forward end. However, the anvil may instead be threadedly secured in a threaded front opening of the housing, eliminating reduced diameter nose 20 and use of a swaging process to produce it. Striker 14 slides within housing 16 to deliver forward impacts to a movable chisel shaft 18 and to an anvil 22 press-fitted into the forward end of housing 16. Anvil 22 is preferably a steel tube that fits closely within the front end opening of housing 16; however, "anvil" as used herein also refers to the corresponding portion of a one piece tool body, or a separate piece that is threadedly secured into the housing as described above. A frustoconical front end portion 26 of anvil 22 thereof has an outer surface that engages a like-shaped inner surface of nose 20 of housing 16 to retain anvil 22 in housing 16.

Figure 4:
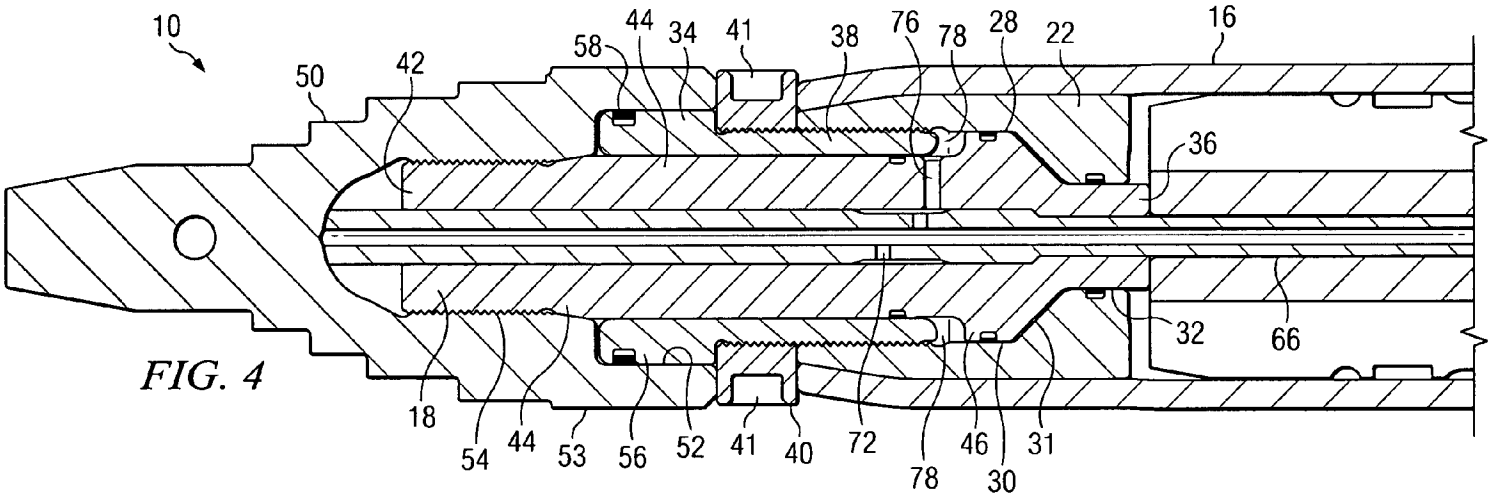
FIGS. 4–6 are partial, enlarged sectional views corresponding to FIGS. 1–3, respectively, wherein the forward section of the tool is illustrated in greater detail.

Referring now to FIG. 4, anvil 22 includes a central bore 28 with a large diameter forwardly opening section 30, intermediate tapered transition 31 and a small diameter rearwardly opening section 32. A tubular bushing 34 includes a threaded end portion 38 that is screwed into threads on the inside surface of large diameter forward section 30 of bore 28 to secure bushing 34 in place. A round jamb nut 40 is threaded onto end portion 38 of bushing 34 forward of anvil 22. Jamb nut 40 has four blind holes 41 on its side set 90 degrees apart that permit use of a spanner to tighten nut 40 against the front face of anvil 22. Clamp loading produced by tightening nut 40 prevents the threaded engagement between bushing 34 and bore 28 of anvil 22 from loosening during tool use. The head assembly can be removed by first loosening jamb nut 40 and then unscrewing bushing 34 from bore 28.

Chisel shaft 18 is slidably mounted in tubular bushing 34 with a small diameter rear end 36 of the chisel shaft extending through the small diameter rearwardly opening section 32 of bore 28. Chisel shaft 18 is slidable in bushing 34 between the position shown in FIG. 4 where the rear end 36 of the shaft protrudes through anvil 22 and the position shown in FIG. 5 where rear end 36 is inside the anvil. Chisel shaft 18 includes a forward threaded end 42, a central body portion 44 that passes through bushing 34 and an enlarged diameter sealing shoulder 46. Enlarged diameter sealing shoulder 46 is rearwardly tapered to small diameter rear end 36 of shaft 18 so as to match the inside profile of bore 28. A seal bearing 48 extends around the outer circumference of shoulder 46 to provide a gas tight seal between shoulder 46 and the inside wall of bore 28. Similar seal bearings 49 are disposed between rear end 36 of bit shaft 18 and the small diameter section 32 of bore 28, and between central body portion 44 and bushing 34.

As illustrated, a stepped chisel head 50 is mounted on the forward threaded end 42 of chisel shaft 18. Chisel head 50 includes an annular wall 53 that forms an axially extending central opening 52. A smaller diameter hole 54 extending forwardly from central opening 52 includes interior threads for securing chisel head 50 onto threaded end 42 of chisel shaft 18. Opening 52 is sized to receive the forward end 56 of bushing 34 and a seal 58 extending around the circumference of forward end 56 of bushing 34 provides a gas tight seal between bushing 34 and the inside wall of central opening 52.

Figure 3:
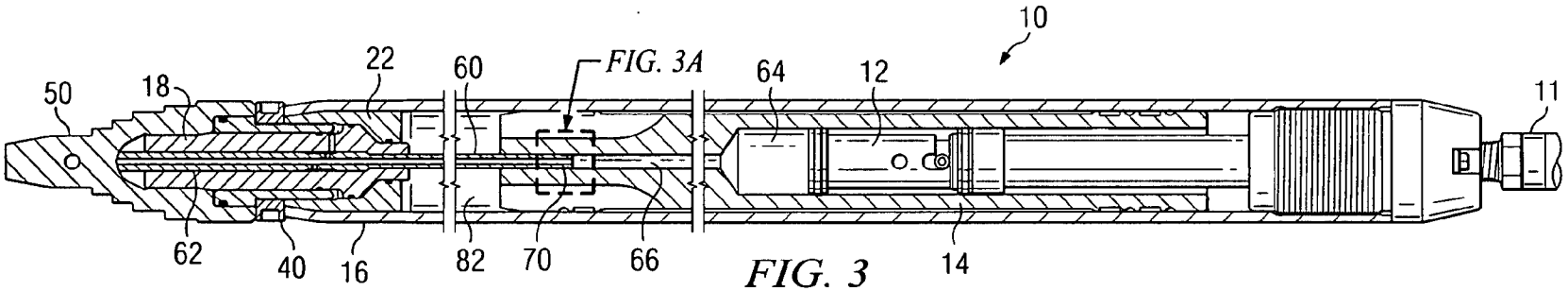
FIG. 3 is a longitudinal sectional view of the pneumatic ground piercing tool of FIG. 1 illustrating the position of the striker upon completion of the impact stroke.
Figure 3A:
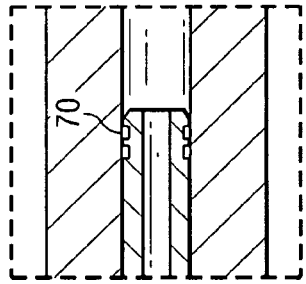
FIG. 3A is an enlarged portion of FIG. 3 illustrating seals between the striker of the ground piercing tool and a fluid supply tube passing through a bore in the striker.

As best illustrated in FIG. 3, a fluid supply tube 60 extends from a central bore 62 formed in chisel shaft 18 into a coaxially extending bore 66 that passes through striker 14 to a variable volume rear striker chamber 64. Bore 66 is configured to allow striker 18 to slide over tube 60 as striker 18 reciprocates. A seal 70 prevents leakage between tube 60 and bore 66. Supply tube 60 is preferably formed from a resilient plastic material and is secured in chisel shaft 18 by means of a suitable adhesive and/or by molding the tube to the contour of bore 62.

Figure 5:
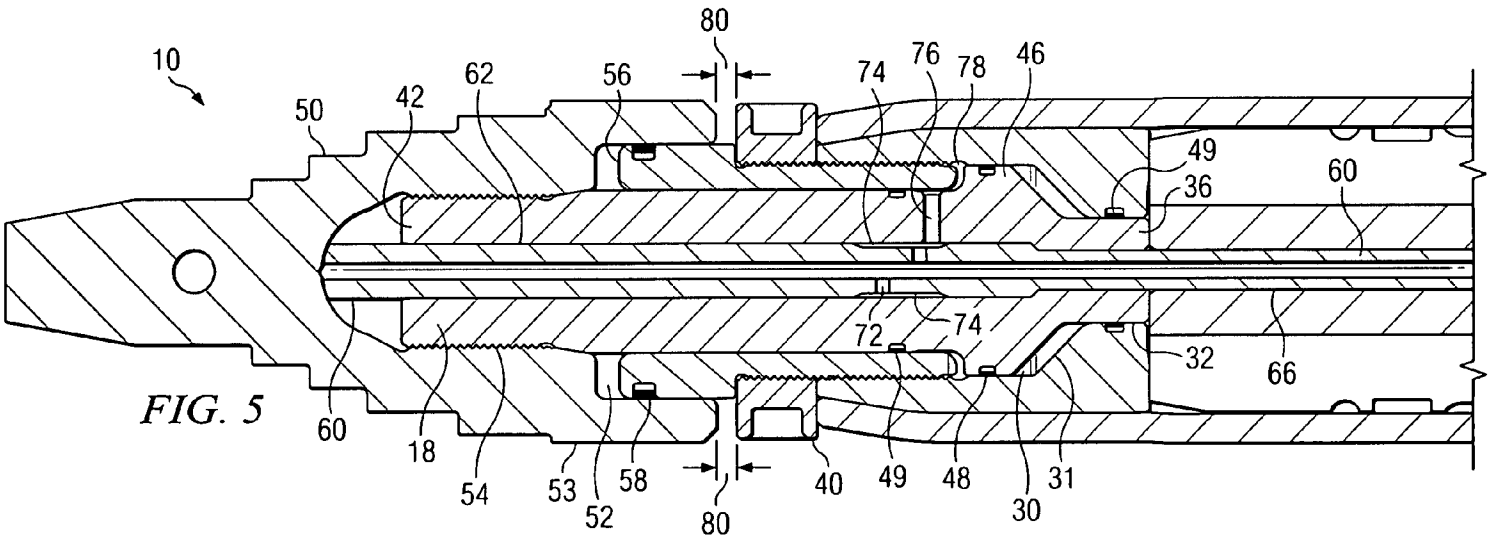
Figure 6:
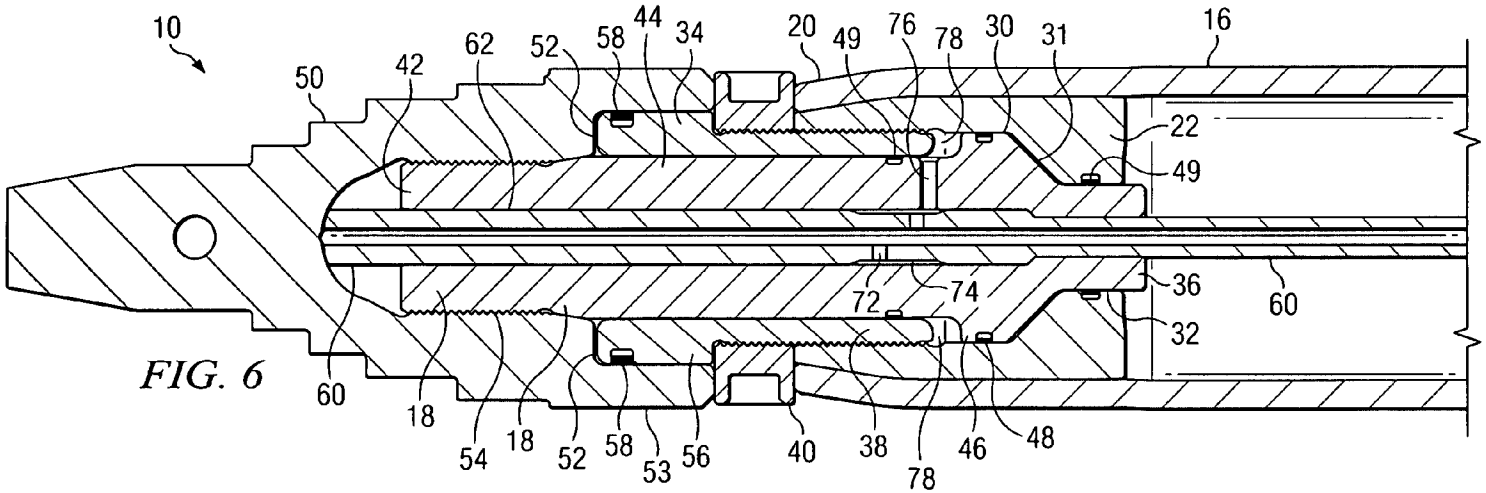

Referring to FIGS. 4–6, supply tube 60 is formed with radially extending ports 72 that communicate with an annular space 74 between the supply tube and the inside wall of bore 62. One or more second ports 76 extend from annular space 74 through chisel shaft 18, opening into an annular variable volume forward chamber 78 formed between anvil 22, chisel shaft 18 and bushing 34. Tube 60 along with radial port 72, annular space 74 and second port 76 form a fluid conduit or passage from rear striker chamber 64 to forward chamber 78, allowing the chamber to be pressurized with compressed air from the rear striker chamber.

Figure 2:
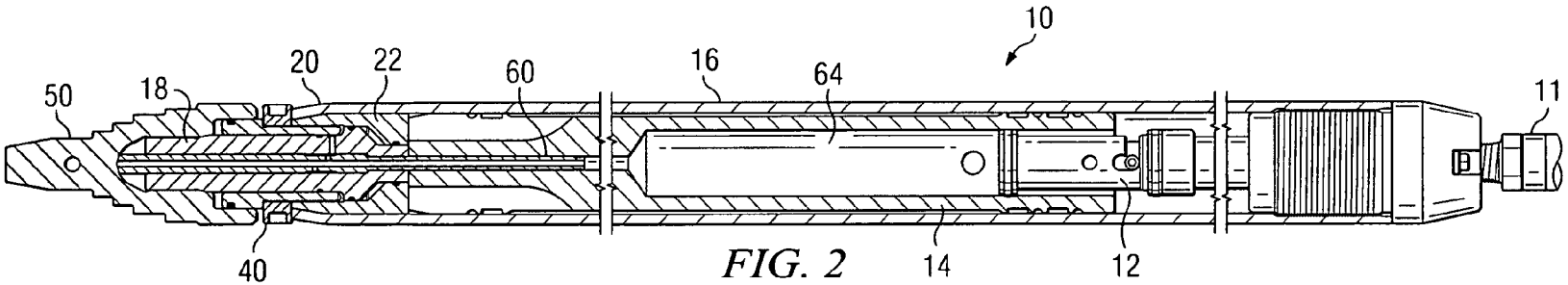
FIG. 2 is a longitudinal sectional view of the pneumatic ground piercing tool of FIG. 1 showing the orientation of the chisel and striker after the striker has impacted the chisel shaft.

Referring to FIGS. 1–3, when tool 10 is launched, air distributing mechanism 12 supplies compressed air to rear striker chamber 64, accelerating the striker forward (left to right). The force accelerating striker 14 to the left simultaneously accelerates tool housing 16 to the right. During launch, the operator must compensate for this force by holding the tool against the wall of the launch pit. FIGS. 1 and 4 show tool 10 at the instant when striker 14 contacts rear end 36 of chisel shaft 18.

FIG. 2 illustrates the position of chisel head 50 and chisel shaft 18 after striker 14 has impacted chisel shaft 18. Shaft 18 and chisel head 50 have been driven forward by striker 14 until the rear end 36 of shaft 18 is completely within bore 28 of anvil 22. The forward movement of chisel shaft 18 relative to anvil 22 and tool housing 16 opens gap 80 between chisel head 50 and jamb nut 40. Striker 14 then impacts anvil 22, driving tool housing 16 to the left and closing gap 80. Simultaneously, air distributing mechanism 12 reverses the flow of compressed air from rear striker chamber 64 to forward striker chamber 82, accelerating striker 14 from right to left.

As striker 14 is accelerated from right to left, a corresponding reaction force accelerates tool housing 16 from left to right, tending to drive housing 16 out of the borehole. As striker 14 moves from left to right, air distributing mechanism 12 vents forward striker chamber 82 (FIG. 3) to atmosphere, stopping the rearward motion of the striker at the position shown in FIG. 3 at which time the cycle is repeated.

Referring again to FIG. 1, if during the forward stroke of striker 14, the operator is unable to compensate for the reaction force accelerating the tool housing 16 to the right as striker 14 is accelerated to the left, housing 16 will move to the right, opening gap 80 (as illustrated in FIG. 5) between chisel head 50 and jamb nut 40. If gap 80 opens to the maximum possible width, bushing 34 impacts shoulder 46 of chisel shaft 18 in the manner of a slide hammer, causing undesirable effects. Chisel head 50 and possibly housing 16 may break free of the frictional forces holding the chisel head and housing in the bore before striker 14 impacts chisel shaft 18. If the frictional forces holding chisel 50 in the borehole are overcome, chisel head 50 may be pulled rearwards from the borehole (right to left), undoing the work accomplished during the previous cycle of striker 14.

Tool 10 of the invention reduces the likelihood of these undesirable effects by compensating in part for magnitude of the reaction force with an air spring. The gas spring in forward chamber 78 is created when the chamber is pressurized through tube 60. In order for gap 80 to open as striker 14 is accelerated forward, bushing 34 must move toward shoulder 46 of chisel shaft 18, overcoming the pressure in forward chamber 78 as the volume of the chamber is reduced. The force required to overcome the pressure in forward chamber 78 substantially offsets the reaction force accelerating tool housing 16, reducing the amount of force that must be applied by the operator.

For example, in the case of one tool having a body diameter of 2.2 inches and a piston (striker) diameter of 1.614 inches, the reaction force generated when the striker 14 is accelerated is calculated to be 155 lbs, assuming a compressed air pressure of 100 psig. The calculated force to overcome the pressure in forward chamber 78 is 83 lbs., resulting in a net force of 72 lbs required to hold tool housing 16 in place as striker 14 is accelerated from left to right during the forward stroke of the striker. Thus, the operator of tool need only compensate for 72 lbs of force rather than 155 lbs. The effect is magnified in the case of larger diameter ground piercing tools. Further, the reduction in the amount of force required to compensate for the reaction force is accomplished without the use of a metallic spring, alleviating the breakage and design problems associated therewith.

Figure 7:
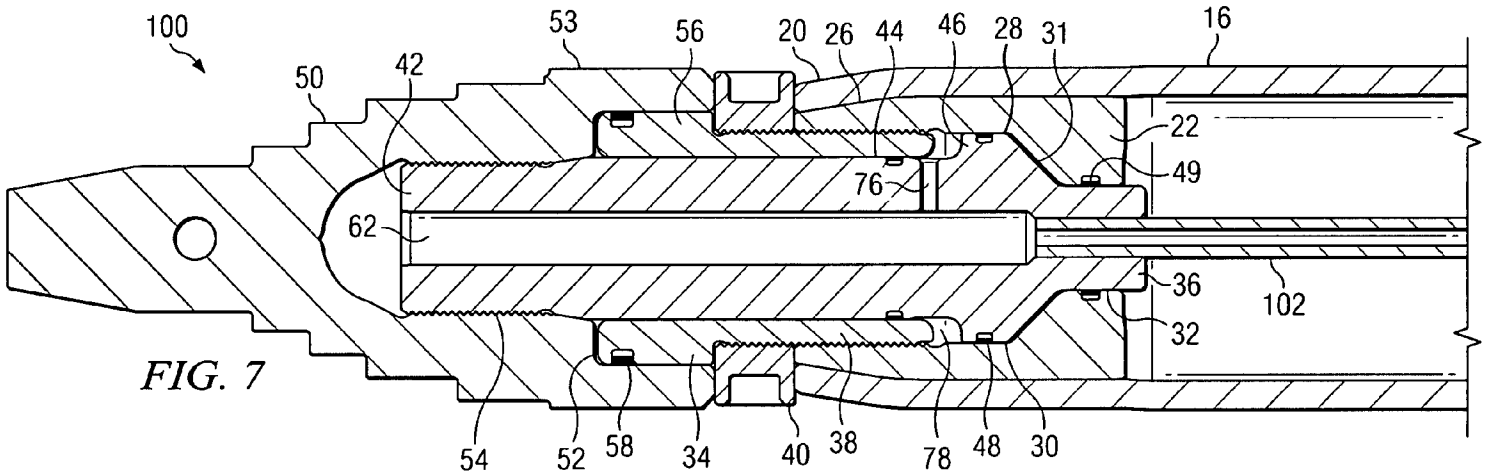
FIG. 7 is a sectional view of a pneumatic ground piercing tool according to the invention with a shortened air inlet tube.
Figure 8:
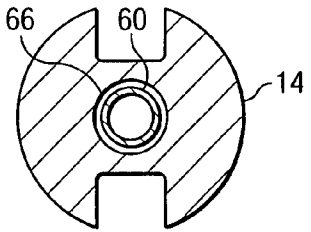
FIG. 8 is a cross sectional view of the striker of FIGS. 1–3 taken along line A–A' of FIG. 1.

Turning to FIG. 7, in an alternate embodiment, a ground piercing tool 100, is in all respects substantially identical to tool 10 of FIG. 1, with the exception of supply tube 102. As illustrated, supply tube 102 extends only partially into chisel shaft 18, eliminating the need for radially extending ports 72.

Figure 9:
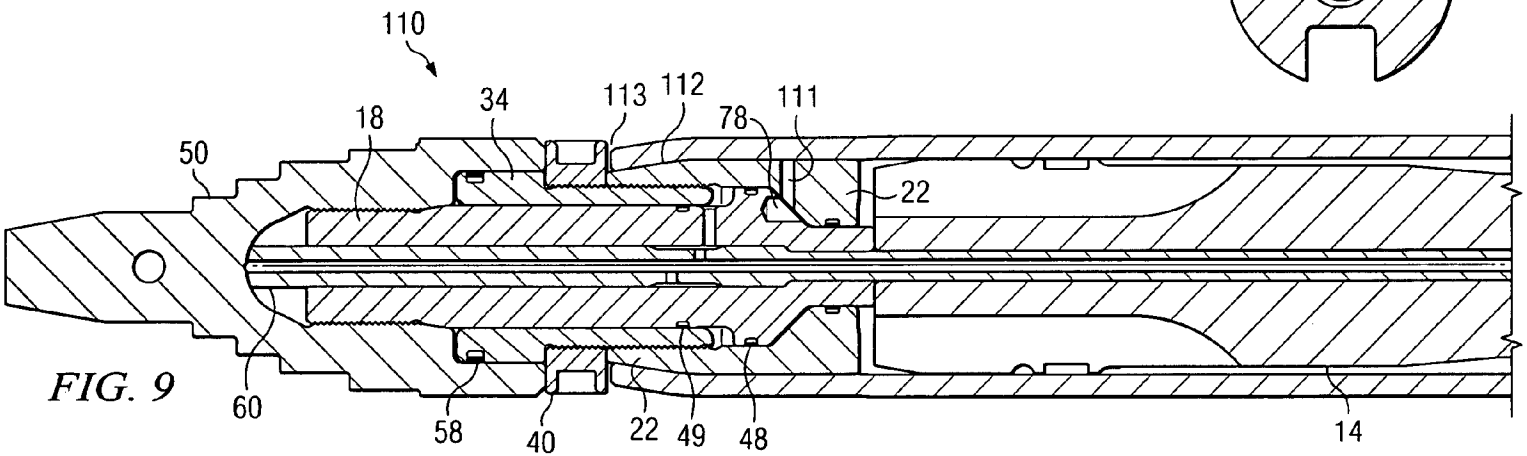
FIG. 9 is a lengthwise sectional view of a further embodiment of the invention with vent passages.

FIG. 9 is a further alternative embodiment of the invention wherein a ground piercing tool 110 is substantially identical to tool 10 of FIG. 1, except that a special vent passage has been added. As the seals of the tool begin to leak, the effectiveness of the air spring is diminished due to pressure in the space behind shoulder 46 that counteracts the pressure in chamber 78. Vent passages 111–113 are provided behind enlarged diameter shoulder 46 of bit shaft 18 to ensure that the pressure on the back side of this piston remains very low. Passage 111 extends radially through anvil 22 from the surface of tapered transition 31 to open onto one or more outwardly opening, frontwardly extending grooves 112 on the outside of anvil 22. The ends of these grooves 112 communicate with an annular gap 113 between jamb nut 40 and housing 16. Gap 113 is open to the atmosphere.

Maintaining low pressure on the back side of the shoulder 46 ensures that the pressure supplied to the front side of shoulder 46 applies the maximum amount of force in the rearward direction (to reset the bit shaft). This aspect of the invention can also be used in connection with known designs that use a coil spring (U.S. Pat. No. 5,095,998 cited above) rather than the air spring described herein.

Figure 10:
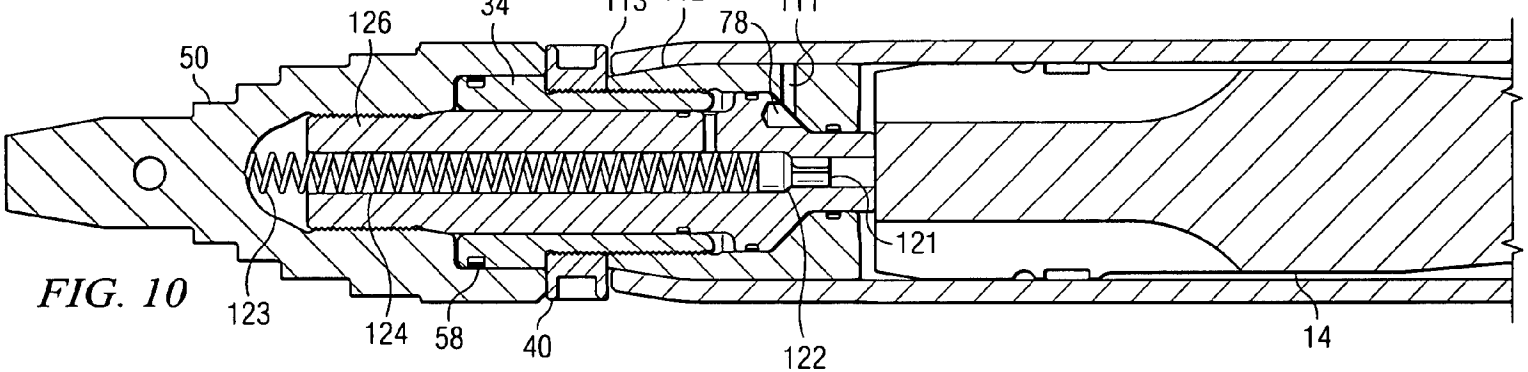
FIG. 10 is a lengthwise sectional view of another embodiment of the invention using a valve in place of a air supply tube.

FIG. 10 illustrates a further embodiment of the invention wherein tube 60 and related structures are omitted entirely. Instead, a central valve 121 is biased against a seat 122 by a relatively large, durable spring 123. Valve 121 is mounted in central bore 124 of bit shaft 126, sealing chamber 78. During the portion of the cycle in which the front pressure chamber ahead of striker 14 is pressurized, such pressure pushes back valve 121 a short distance, slighting compressing spring 123 and opening the passages leading to chamber 78. Chamber 78 then remains pressurized during the exhaust stage of the cycle because valve 121 closes under the action of spring 123 when the pressure ahead of striker 14 drops. This embodiment avoids the need to provide an air supply tube and thus may have better durability that the previous embodiments. While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

The invention claimed is:

1. A ground piercing tool, comprising an elongated tubular tool housing, including a front anvil having a lengthwise bore therein;

a striker disposed for reciprocation within an internal chamber of the housing to impart impacts to an impact surface of the anvil for driving the tool forwardly through the ground;

a chisel including a front head and a rearwardly extending chisel shaft slidably disposed in the bore of the anvil, which chisel is movable between a rearwardmost position at which a rear end portion of the chisel shaft protrudes from the bore of the anvil to receive an initial impact from the striker, and a forwardmost position at which the striker impacts on a rear impact surface of the anvil; and a distributing mechanism that reciprocates the striker in response to a supply of compressed fluid, wherein the housing and chisel shaft cooperate to define a front chamber that decreases in volume as the chisel moves forward relative to the housing, and the distributing mechanism includes passages that conduct compressed fluid to the front chamber, which front chamber is configured to form a gas spring using such compressed fluid.

2. The tool of claim 1, wherein the striker further comprises a central bore that communicates with the distributing mechanism for supplying the front chamber with compressed fluid.

3. The tool of claim 1, wherein the chisel shaft has a longitudinally extending central bore for supplying the front chamber with compressed fluid, the longitudinally extending bore being coaxial with the central bore of the striker.

4. The tool of claim 3, wherein the chisel shaft further comprises a passage extending radially from the longitudinally extending central bore to the front chamber for supplying the front chamber with compressed fluid.

5. The tool of claim 4, further comprising a fluid supply tube extending through the central bore of the striker and into the longitudinally extending central bore of the chisel shaft to supply the front chamber with compressed fluid.

6. The tool of claim 5, wherein the fluid tube is secured in the longitudinally extending central bore of the chisel shaft.

7. The tool of claim 1, wherein the front chamber is formed between the anvil and the chisel shaft.

8. The tool of claim 1, wherein the housing has a nose including a reduced diameter cylindrical front end portion and a forwardly tapering portion rearwardly thereof.

9. The tool of claim 8, wherein the anvil comprises an insert having a frustoconical front end portion extending into the nose, the front end portion being configured to match the inside profile of the nose.

10. The tool of claim 1 further comprising a forwardly extending bushing secured to the anvil, the chisel shaft being slidably mounted in the bushing.

11. The tool of claim 1, wherein the chisel shaft has a radially extending shoulder, such that the housing and a front surface of the shoulder of the chisel shaft cooperate to define the front chamber that decreases in volume as the chisel moves forward relative to the housing, and passages are formed in the housing for venting a space between a rear surface of the shoulder of the chisel shaft and the anvil.

12. A ground piercing tool, comprising:

an elongated tubular tool housing, including a front anvil having a lengthwise bore therein;

a striker disposed for reciprocation within an internal chamber of the housing to impart impacts to an impact surface of the anvil for driving the tool forwardly through the ground, the striker having a lengthwise, frontwardly opening central bore therein coaxial with the bore of the anvil;

a chisel including a front head and a rearwardly extending chisel shaft slidably disposed in the bore of the anvil, which chisel is movable between a rearwardmost position at which a rear end portion of the chisel shaft protrudes from the bore of the anvil to receive an initial impact from the striker, and a forwardmost position at which the striker impacts on a rear impact surface of the anvil; and a distributing mechanism that reciprocates the striker in response to a supply of compressed fluid, including a fluid inlet tube mounted in the bores of the anvil and striker having a radial port, a rear end of the inlet tube being in communication with the distributing mechanism, wherein the housing and chisel shaft cooperate to define a front chamber that decreases in volume as the chisel moves forward relative to the housing, and the chisel shaft has a radial passage therein that conducts compressed fluid from the radial port of the inlet tube to the front chamber, which front chamber is configured to form a gas spring using such compressed fluid.

13. The tool of claim 12, wherein the housing has a nose including a reduced diameter cylindrical front end portion and a forwardly tapering portion rearwardly thereof and wherein the anvil comprises an insert having a frustoconical front end portion configured to match the inside profile of the nose.

14. The tool of claim 12, wherein the chisel shaft is supported in a bushing, the bushing being threadedly engaged in the central bore of the anvil.

15. A ground piercing tool, comprising an elongated tubular tool housing, including a front anvil having a lengthwise bore therein;

a striker disposed for reciprocation within an internal chamber of the housing to impart impacts to an impact surface of the anvil for driving the tool forwardly through the ground;

a chisel including a front head, a chisel shaft extending rearwardly from the head, which chisel shaft is slidably disposed in the bore of the anvil and is movable between a rearwardmost position at which a rear end portion of the chisel shaft protrudes from the bore of the anvil to receive an initial impact from the striker, and a forwardmost position at which the striker impacts on a rear impact surface of the anvil, and a tubular bushing in which a midportion of the chisel shaft is slidably mounted, the bushing having a rearwardly extending threaded external portion that is threadedly engaged with internal threads in the bore of the anvil in order to secure the chisel to the anvil;

a jamb nut mounted on the threaded external portion of the bushing in front of the anvil, which jamb nut can be tightened against the anvil to apply a clamp load to the threaded connection between the bushing and the anvil; and a distributing mechanism that reciprocates the striker in response to a supply of compressed fluid, wherein the housing and chisel shaft cooperate to define a front chamber that decreases in volume as the chisel moves forward relative to the housing, and the distributing mechanism includes passages that conduct compressed fluid to the front chamber, which front chamber is configured to form an gas spring using such compressed fluid.

16. A ground piercing tool, comprising:

an elongated tubular tool housing, including a front anvil having a lengthwise bore therein;

a striker disposed for reciprocation within an internal chamber of the housing to impart impacts to an impact surface of the anvil for driving the tool forwardly through the ground;

a distributing mechanism that reciprocates the striker in response to a supply of compressed fluid;

a chisel including a front head and a rearwardly extending chisel shaft slidably disposed in the bore of the anvil, which chisel is movable between a rearwardmost position at which a rear end portion of the chisel shaft protrudes from the bore of the anvil to receive an initial impact from the striker, and a forwardmost position at which the striker impacts on a rear impact surface of the anvil, wherein the chisel shaft has a radially extending shoulder, and the housing and a front surface of the shoulder of the chisel shaft cooperate to define a front chamber that decreases in volume as the chisel moves forward relative to the housing;

a spring disposed in the front chamber that resists the decrease in volume of the front chamber as the chisel moves forward relative to the housing; and a passage in the housing for venting a space between a rear surface of the shoulder of the chisel shaft and the anvil.

17. The tool of claim 16, wherein the spring is a coil spring.

18. The tool of claim 16, wherein the spring is a gas spring.

* * * * *